United States Patent [19]

De Bijl et al.

[11] Patent Number: 4,525,648

[45] Date of Patent: Jun. 25, 1985

[54] DC/AC CONVERTER WITH VOLTAGE DEPENDENT TIMING CIRCUIT FOR DISCHARGE LAMPS

[75] Inventors: Adrianus M. J. De Bijl; Henri A. I. Melai, both of Eindhoven, Netherlands

[73] Assignee: U.S. Philips Corporation, New York, N.Y.

[21] Appl. No.: 485,532

[22] Filed: Apr. 15, 1983

[30] Foreign Application Priority Data

Apr. 20, 1982 [NL] Netherlands ..... 8201631

[51] Int. Cl.[3] ..... H05B 41/24

[52] U.S. Cl. ..... 315/224; 315/210; 315/239; 315/287; 363/97; 363/78; 315/DIG. 2; 315/DIG. 7

[58] Field of Search ..... 315/224, 225, 210, 287, 315/DIG. 2, DIG. 7, 307, 275, 222, 223, 219, 239, 310; 363/97, 78, 165; 331/177 R

[56] References Cited

U.S. PATENT DOCUMENTS 4,060,751 11/1977 Anderson ..... 315/DIG. 2 X
4,075,476 2/1978 Pitel ..... 315/239 X
4,259,614 3/1981 Kohler ..... 315/DIG. 7 X
4,375,608 3/1983 Kohler ..... 315/DIG. 7 X

FOREIGN PATENT DOCUMENTS 0065794 12/1982 European Pat. Off. ..... 315/224
2106339 4/1983 United Kingdom ..... 315/219

*Primary Examiner*—David K. Moore
*Assistant Examiner*—Vincent DeLuca
*Attorney, Agent, or Firm*—Robert T. Mayer; Bernard Franzblau

[57] ABSTRACT

A DC/AC converter provided with two transistors (11 and 20) alternately conductive to supply current to an inductively stabilized discharge lamp (16, 15) to be connected to the converter. The lamp is connected in series with a primary winding (12) of a current transformer. A secondary winding (30, 31) of the transformer is connected to a timing circuit (32 to 35; 32' to 35') of a control device of the transistors. The timing circuit is provided with voltage-dependent elements, i.e. Zener diodes (35, 35'). The combination of the current transformer and the Zener diodes causes the frequency of the converter, during starting of the lamp, to be larger than during the operating condition of the lamp. This insures that the lamp electrodes are properly heated before the lamp ignites.

9 Claims, 1 Drawing Figure

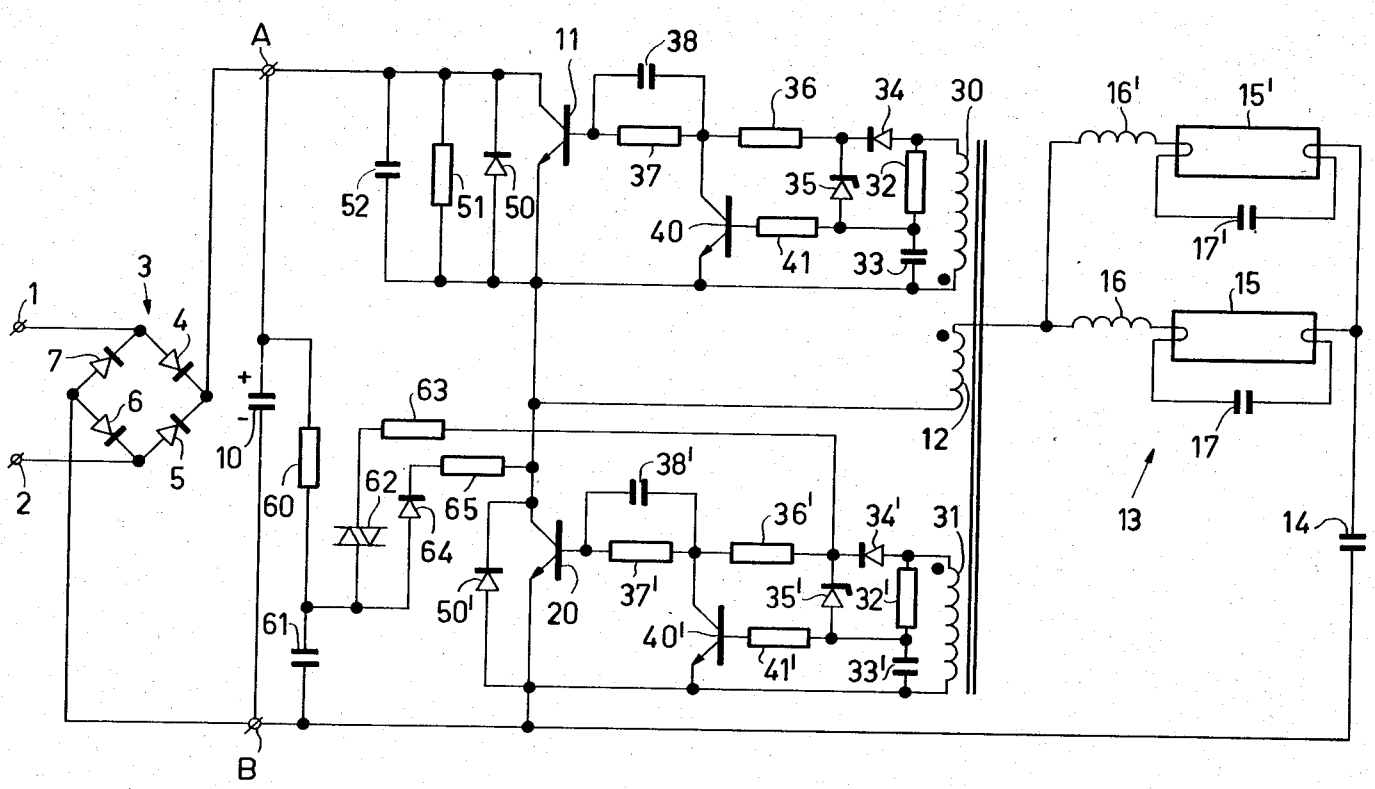
1
2
3
4
5
6
7
10
11
12
13
14
15
15'
16
16'
17
17'
20
30
31
32
32'
33
33'
34
34'
35
35'
36
36'
37
37'
38
38'
40
40'
41
41'
50
50'
51
52
60
61
62
63
64
65
A
B

DC/AC CONVERTER WITH VOLTAGE DEPENDENT TIMING CIRCUIT FOR DISCHARGE LAMPS

This invention relates to a DC/AC converter for the ignition and supply of alternating current to a gas and/or vapour discharge lamp. More particularly to a converter which has two input terminals to be connected to a direct voltage source and with the two input terminals connected to each other through a first series arrangement which comprises at least a first transistor, a load circuit which—in the operating condition—comprises the lamp, and a capacitor. The load circuit, together with at least the capacitor is shunted by a second transistor, and the load circuit is provided with a circuit element shunting the lamp as well as with a reactive circuit element in series with the lamp. A control device is present by means of which the two transistors are alternately rendered conductive and which is provided with a timing circuit having a variable time constant in order to ensure that the frequency at which the two transistors are alternately reduced conductive, when the converter is switched on but with the lamp not yet ignited, is different from that in the operating condition of the lamp so that the starting current is limited.

The term "transistor" is to be understood to mean herein a semiconductor circuit element which can be rendered non-conducting by means of a control electrode.

A DC/AC converter of the said kind has already been described in the U.S. patent application No. 376,808 filed 5/10/82. This DC/AC converter has the disadvantage that the converter—after a substantially constant build-up time—starts to operate at the operating frequency destined for an ignited lamp. In the case of a very slowly igniting—or a defective—lamp, a situation may arise in which large electric currents flow through the converter. This could lead to damage of the converter.

An object of the invention is to provide a DC/AC converter of the kind mentioned in the preamble, which converter operates at the operating frequency only after the lamp concerned has been ignited. As a result, the risk of damage to the converter by large currents is relatively small.

A DC/AC converter according to the invention for the ignition and supply of alternating current to a gas and/or vapour discharge lamp, which converter has two input terminals which are to be connected to a direct voltage source, the two input terminals being connected to each other through a first series arrangement which comprises at least a first transistor, a load circuit which—in the operating condition—comprises the lamp, and a capacitor. The load circuit together with at least the capacitor, is shunted by a second transistor. The load circuit is provided with a circuit element shunting the lamp as well as with a reactive circuit element in series with the lamp. A control device is present by means of which the two transistors are alternately rendered conductive and which is provided with a timing circuit having a variable time constant in order to ensure that the frequency at which the two transistors are alternately rendered conductive, when the converter is switched on but with the lamp not yet ignited, is different from that in the operating condition of the lamp so that the starting current is limited. The converter according to the invention is characterized in that the load circuit includes, in series with the lamp, a primary winding of a transformer, and in that the timing circuit is connected between two terminals of a secondary winding of the transformer and the time constant of the timing circuit is voltage-dependent.

An advantage of this DC/AC converter is that the operating frequency is realized only when the lamp is ignited. Consequently, the risk of damage to the converter by large electric currents is relatively small.

For further explanation, the following information can be given. A discharge lamp behaves during its ignition as a different electric impedance than it does in its ignited condition (operating condition). During the ignition, the lamp in fact has a higher impedance than in the ignited condition. For the ignition of the lamp, an electric voltage (ignition voltage) should be applied across the lamp which is generally larger than the operating voltage of the lamp which is present in the operating condition. In the case where the lamp is provided with preheatable electrodes, the ignition voltage will generally have to be applied across the lamp with a certain delay. Thus the lamp is prevented from igniting with too cold electrodes. In fact such a cold ignition mostly leads to shortening of the life of the lamp.

The invention is based, inter alia, on the idea to measure, with the aid of the primary transformer winding in series with the lamp, whether the lamp is already ignited. When the lamp is not yet ignited, comparatively large currents are liable to flow through the reactive circuit element and the circuit element shunting the lamp. However, the increasing current in the primary winding of the transformer will then induce immediately a large voltage in the secondary winding of this transformer. The invention is further based on the idea to vary, with this large voltage, the time constant of the timing circuit, and thus to influence the operation of the timing circuit. This results in a variation of the control frequency of the two transistors, which leads to the realization of the starting frequency of the converter.

When the lamp has been ignited, the voltage induced in the secondary winding of the transformer will decrease, as a result of which the operating time constant of the timing circuit is obtained. Consequently, the converter will operate at the operating frequency.

It should be noted that the (variable) time constant of the timing circuit of the above described DC/AC converter (U.S. patent application No. 376,808) is mainly time-dependent.

It should be noted that in the U.S. Pat. No. 4,259,614 there is also described a DC/AC converter provided with a few transistors for the ignition and the supply of a discharge lamp. Also in this known converter, the starting frequency differs from the operating frequency. In this known converter, the load current flows, however, through a part of the control circuit of the transistors so that this control circuit must be proportioned for this current. In a converter according to the present invention, the transformer provides isolation between the load circuit and the control circuit of the transistors.

The discharge lamp is, for example, a sodium lamp or a mercury lamp. This lamp may be of the high-pressure or of the low-pressure type.

The reactive circuit element in series with the lamp is, for example, a coil and the circuit element shunting the lamp is, for example, a capacitor. When the lamp is provided with preheatable electrodes, the circuit element shunting the lamp, for example, the capacitor just mentioned, may be connected between the ends of the electrodes remote from the supply source. This shunting circuit element then also conveys the preheating current for these electrodes during the ignition process.

The timing circuit comprises, for example, a voltage-dependent resistor (VDR).

In a preferred embodiment of a DC/AC converter according to the invention, the timing circuit comprises a series arrangement of a resistor and a capacitor, a Zener diode being present in a branch shunting the resistor.

An advantage of this preferred embodiment is that the control circuit is simple and can operate in a reliable manner. This is inter alia due to the fact that the threshold voltage of a Zener diode is generally fairly constant.

An embodiment of the invention will now be described more fully with reference to the accompanying drawing.

The FIGURE shows a DC/AC converter according to the invention and a supply arrangement for this converter as well as two lamps to be ignited and supplied by means of this converter. The supply arrangement comprises two input terminals 1 and 2 destined to be connected to an alternating voltage source. These terminals 1 and 2 have connected to them a rectifier bridge 3 having four diodes (4 to 7 inclusive). For example, a filter may further be provided between the terminals 1 and 2 on the one hand and the bridge 3 on the other hand. An output terminal of the rectifier bridge 3 is connected to a first input terminal (A) of the converter. A second output terminal of the rectifier bridge 3 is connected to an input terminal B of the converter.

The converter will now be described. The terminals A and B are connected to each other through a capacitor 10 and also through a series arrangement of a first transistor 11, a primary winding 12 of a current transformer and a load circuit 13, the details of which will be indicated below, as well as a capacitor 14.

The load circuit 13 comprises two substantially equal parallel branches. Each of these branches comprises a low-pressure mercury vapour discharge lamp 15 and 15', respectively, of approximately 50 Watt each, in series with a reactive circuit element 16 and 16', respectively, constructed as a coil. Each of the lamps has two preheatable electrodes. The ends of the electrodes, associated with a lamp, remote from the supply source are connected to each other through a capacitor 17 and 17', respectively. Each of these capacitors 17, 17' therefore constitutes a circuit element shunting the lamp concerned.

The series arrangement of the primary winding 12 of the transformer, the load circuit 13 and the capacitor 14 is shunted by a second transistor 20. Each of the two transistors 11 and 12 is of the NPN type. In the circuit, the collector of the transistor 11 is connected to the positive input terminal A of the converter. The emitter of the transistor 11 is connected to the collector of the transistor 20. The emitter of the transistor 20 is connected to the negative input terminal B of the converter.

The current transformer with the primary winding 12 has two secondary windings 30 and 31, respectively. The secondary winding 30 is connected to an input circuit of a control device of the transistor 11. The secondary winding 31 is connected to an input circuit of a control device of the transistor 20. The control devices are substantially equal to each other. The ends of the secondary winding 30 are then connected to each other through a timing circuit comprising a series arrangement of a resistor 32 and a capacitor 33. The timing circuit further comprises a series arrangement of a diode 34 and a Zener diode 35 shunting the resistor 32. A corresponding timing circuit 32' to 35' inclusive connects the ends of the secondary winding 31 to each other. Further identical circuit elements in the control device of the transistor 20 are also accented. A junction point between the diode 34 and the Zener diode 35 is connected through a series arrangement of two resistors 36, 37 to the base of the transistor 11. The resistor 37 is shunted by a capacitor 38. An auxiliary transistor 40, likewise of the NPN type, is connected between a junction point between the resistors 36 and 37 on the one hand and the emitter of the transistor 11 on the other hand. A junction between the resistor 32 and the capacitor 33 is connected through a resistor 41 to the base of the auxiliary transistor 40.

A diode 50 is connected in parallel opposition to the transistor 11. A diode 50' is connected in parallel opposition to the transistor 20. The transistor 11 is further shunted by both a resistor 51 and a capacitor 52.

Finally, a circuit is provided for starting the converter. This circuit comprises, inter alia, a series arrangement of a resistor 60 and a capacitor 61 shunting the capacitor 10. A junction point between the resistor 60 and the capacitor 61 is connected to a bidirectional threshold element (Diac) 62. The other side of this threshold element 62 is connected through a resistor 63 to a junction point between the resistor 36' and the diode 34' of the control device of the transistor 20. The junction point between the resistor 60 and the capacitor 61 is also connected to a diode 64. The other side of this diode 64 is connected through a resistor 65 to the collector of the transistor 20.

The circuit described operates as follows. The terminals 1 and 2 are connected to an alternating voltage of, for example, approximately 220 V, 50 Hz. As a result, a direct voltage is applied through the rectifier bridge 3 between the terminals A and B of the converter. Consequently, current will flow first from A through the resistor 51, the primary winding 12 of the current transformer, the load circuit 13 and the capacitor 14 to the terminal B. As a result the capacitors 17, 17' and 14 are charged. Moreover, the capacitor 61 will be charged through the resistor 60. When the threshold voltage of the threshold element 62 is then reached, the capacitor 61 will be discharged through, inter alia, the resistors 63, 36', 37' and the base/emitter junction of the transistor 20. This discharging process ensures that the transistor 20 begins to conduct for the first time. As a result, inert alia the capacitor 14 will be discharged in the circuit 14, 13, 12, 20, 14. Since this discharge current also flows through the primary winding 12 of the current transformer, voltages are induced in the two secondary windings 30 and 31. The induced voltage in the winding 31 has a sense which keeps the transistor 20 conducting. The timing circuit 32' to 35' inclusive will make the auxiliary transistor 40' conduct after a given period of time. Consequently, also with the aid of the capacitor 38', the transistor 20 will become non-conducting. The current of the load circuit 13 then flows through the combination of the diode 50 and the capacitor 52, and through the capacitor 10 back to the capacitor 14. The instantaneous value of this current decreases and near its zero passage the transistor 11 is made to conduct by means of the winding 30, the diode 34 and the resistors 36 and 37. In the same manner as described for the switching procedure of the transistor 20, after some time the transistor 11 is then rendered non-conducting again. The converter has now started. The transistors 11 and 20 are now rendered conducting in turn. The circuit 64, 65 then ensures that the starting circuit 62, 63 becomes inoperative.

The lamps 15 and 15' are then not yet ignited. The load circuit 13 in this case comprises a parallel arrangement of two practically equal branches each consisting of a series arrangement of a coil 16 and a capacitor 17 (16' and 17', respectively). A damping of this circuit by the lamps is not yet obtained. Without the presence of the Zener diodes 35 and 35' in the timing circuits, the frequency of the current through the load circuit 13 would be practically adjusted to the resonance frequency of this circuit, as a result of which voltages of such a magnitude would be applied across the lamps 15 and 15' that these lamps would ignite with cold cathodes. Furthermore, if these lamps were to be defective, an electrically inadmissible situation could occur in the load circuit 13 due to very high currents.

When the current in the primary winding 12 of the transformer increases, however, already a comparatively high voltage is now induced in the secondary windings 30 and 31, which ensure that the Zener voltage of the Zener diode 35 (and 35', respectively) is reached. Thus, in fact the (voltage-dependent) time constant of the timing circuit 32 to 35 inclusive (32' to 35' inclusive) is influenced, in this case by the fact that the resistor 32 and 32', respectively, is shunted by the circuit comprising the then conducting Zener diode 35 and 35', respectively. The result is that the voltage at the capacitor 33 increases more rapidly to the value at which the auxiliary transistor 40 becomes conducting, as a result of which the combination of the capacitor 38 and the auxiliary transistor 40 more rapidly causes the main transistor 11 concerned to become non-conducting. As a result, the frequency of the converter reaches a higher value. This higher frequency leads to a higher voltage across the coils 16 and 16', respectively, and hence to a smaller voltage across the lamps 15 and 15', respectively. Thus, the lamps have an opportunity to preheat their electrodes through the capacitors 17 and 17', respectively. Consequently, there is no risk of the lamps igniting with too cold electrodes. Only when the electrodes are preheated sufficiently is the voltage present across the lamps sufficient to ignite these lamps. The current through the load circuit and hence through the primary winding 12 of the current transformer is then no longer liable to assume a high value because now the damping action of the lamps is achieved. As a result, the voltages induced in the windings 30 and 31 will be comparatively small so that the Zener voltage of the Zener diodes 35 and 35' is no longer reached. This means that it takes more time to charge the capacitor 33, as a result of which the transistor 40 also is rendered conducting only at a later instant. Consequently, by the combination of the capacitor 38 and the auxiliary transistor 40, the main transistor 11 also will be rendered conducting only at a later stage. This also applies to the control device of the transistor 20. This means that the frequency at which the converter then operates is lower than it was during the ignition procedure of the lamps.

In a practical embodiment, the circuit elements have the values indicated in the Table below.

Capacitor 10 approximately—47 μF
Capacitor 14 approximately—0.5 μF
Capacitors 17 and 17' each approximately—12 nF
Capacitors 33 and 33' each approximately—22 nF
Capacitors 38 and 38' each approximately—10 μF
Capacitor 52 approximately—3.3 nF
Capacitor 61 approximately—100 nF
Coils 16 and 16' each approximately—2 mH
Transformation ratio of the current transformer (12; 30, 31) approximately—1:5:5
Resistors 32 and 32' each approximately—1.5 kΩ
Resistors 36 and 36' each approximately—22Ω
Resistors 37 and 37' each approximately—100Ω
Resistors 41 and 41' each approximately—100Ω
Resistor 51 approximately—1 MΩ
Resistor 60 approximately—680 kΩ
Resistor 63 approximately—100Ω
Resistor 65 approximately—10 kΩ

The operating voltage of the lamp 15, and of the lamp 15', is approximately 145 Volt. During the ignition, approximately 300 Volt is applied across each of these lamps.

The starting frequency of this arrangement is approximately 40 kHz. The operating frequency, i.e. the frequency in the case of ignited lamps 15 and 15', respectively, is approximately 25 kHz.

If desired, the timing circuit parts 32 and 33, 32' and 33' may be made variable, for example, by replacing the resistors 32 and 32' by variable circuit elements. Thus, a dimming function of the lamps 15 and 15' can be realized.

An advantage of the arrangement described is that the lamps ignite well within preheated electrodes, which favourably influences the life of these lamps, and furthermore there is only a small possibility of the occurrence of large electric currents in the converter.

What is claimed is:

1. A DC/AC converter for the ignition and the supply of alternating current to an electric discharge lamp comprising: two input terminals for connection to a direct voltage source, means connecting the two input terminals to a first series arrangement which comprises at least a first transistor, a load circuit which—in the operating condition—comprises the lamp, and a capacitor, the load circuit and at least the capacitor being shunted by a second transistor, the load circuit including a circuit element shunting the lamp and a reactive circuit element in series with the lamp, a control device connected in circuit so as to make the two transistors alternately conductive and which includes a timing circuit having a variable time constant in order to ensure that the frequency at which the two transistors are alternately rendered conductive, when the converter is switched on but with the lamp not yet ignited, is different from the frequency of the two transistors in the operating condition of the lamp so that the starting current is limited, and wherein the load circuit includes, in series with the lamp, a primary winding of a transformer, and the timing circuit is connected between two terminals of a secondary winding of the transformer and the time constant of said timing circuit is voltage-dependent.

2. A DC/AC converter as claimed in claim 1 wherein the timing circuit comprises, a series arrangement of a resistor and a capacitor, and a Zener diode connected in a branch shunting the resistor.

3. An electronic ballast-inverter circuit for a discharge lamp comprising: a pair of input terminals for connection to a source of DC voltage, a transformer having a primary winding and first and second secondary windings, first and second transistors each having a control electrode, means connecting said first and second transistors and said transformer in circuit to said input terminals so as to form a DC/AC converter having a preignition (starting) frequency that is different from the lamp operating frequency, a load circuit comprising a first reactive element and a capacitor adapted to be connected in a series circuit with the discharge lamp and a second reactive element adapted to be connected in shunt with the lamp, first and second control circuits coupling said first and second secondary windings to the control electrodes of the first and second transistors, respectively, so as to alternately drive the transistors into conduction, means serially connecting the first transistor, the transformer primary winding and the load circuit across said input terminals, each of said control circuits including a timing circuit energized by its respective secondary winding and responsive to the current in the transformer primary winding to control the converter frequency such that the converter operates at a first frequency prior to ignition of the lamp and switches over to a second frequency when the lamp is in operation, said first frequency being chosen so that the starting current for the lamp is limited to a safe value, and means connecting the second transistor in shunt with the series arrangement of the primary winding and the load circuit.

4. A ballast-inverter circuit as claimed in claim 3 wherein said first and second reactive elements comprise an inductor and a capacitor, respectively, and said timing circuits are coupled to their respective secondary windings so as to be electrically isolated from the load circuit.

5. A ballast-inverter circuit as claimed in claim 3 wherein at least one of said timing circuits includes a voltage-dependent switching element that switches in response to a given voltage induced in its secondary winding by current flow in the transformer primary winding thereby to alter a parameter of the timing circuit so as to adjust the converter to operate at said first frequency prior to lamp ignition.

6. A ballast-inverter circuit as claimed in claim 3 wherein the time constant of at least one said timing circuits is varied as a function of the voltage induced in its respective transformer secondary winding thereby to control the frequency of the converter.

7. A ballast-inverter circuit as claimed in claim 3 wherein said first and second reactive elements comprise an inductor and a capacitor, respectively, and said timing circuits each include a voltage-dependent element controlled by the voltage induced in its respective secondary winding so as to adjust the converter frequency to said first frequency prior to lamp ignition and to adjust the converter to said second frequency when the lamp ignites, said first frequency being higher than said second frequency.

8. A ballast-inverter circuit as claimed in claim 3 wherein at least the timing circuit of the first control circuit comprises a resistor and a capacitor serially connected to the first secondary winding, a voltage-threshold element in shunt with the resistor, a third transistor coupled to the control electrode of the first transistor to control its conduction, and means coupling a control electrode of the third transistor to said voltage-threshold element.

9. A ballast-inverter circuit as claimed in claim 3 wherein the first timing circuit includes a voltage-dependent element for adjusting the first timing circuit so as to make the preignition frequency of the converter independent of the load circuit.

* * * * *